US006494600B2

(12) United States Patent
Liang et al.

(10) Patent No.: US 6,494,600 B2
(45) Date of Patent: Dec. 17, 2002

(54) HIGH THERMAL DIFFUSION EFFICIENCY LIGHT DEVICE

(75) Inventors: Don Liang, Chungli (TW); Kan-Chuan Cheng, Taoyuan (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 09/849,310

(22) Filed: May 7, 2001

(65) Prior Publication Data

US 2002/0109994 A1 Aug. 15, 2002

(30) Foreign Application Priority Data

Feb. 14, 2001 (TW) ..... 90103298 A

(51) Int. Cl.[7] ..... F21V 29/00
(52) U.S. Cl. ..... 362/373; 362/294
(58) Field of Search ..... 362/218, 294, 362/345, 373

(56) References Cited

U.S. PATENT DOCUMENTS 3,639,751 A * 2/1972 Pichel ..... 362/373
4,321,659 A * 3/1982 Wheeler ..... 362/294
5,001,608 A * 3/1991 Kehrli et al. ..... 362/294
5,045,748 A * 9/1991 Ahlgren et al. ..... 313/113
5,420,769 A * 5/1995 Ahlgren et al. ..... 362/294
5,674,000 A * 10/1997 Kalley ..... 362/294
5,746,495 A * 5/1998 Klamm ..... 362/373
6,004,010 A * 12/1999 Inage et al. ..... 362/294

* cited by examiner

*Primary Examiner*—Alan Cariaso
(74) *Attorney, Agent, or Firm*—Nixon Peabody LLP; Donald R. Studebaker

(57) ABSTRACT

A light device includes a light bulb set and a thermal diffusion guide disposed around the light bulb set. The light bulb set has an outer wall. The thermal diffusion guide keeps a distance from the outer wall to form an air passage for restricting an air flow to flow through. The thermal diffusion guide has an outer rim forming a first air surface between the rim and the outer wall for collecting the air flow to flow into the air passage, so as to increase thermal diffusion efficiency. The present invention further discloses a light device, including a light bulb set, a shield above the light bulb set and a diffusion plate above the shield. A first air isolation layer is formed between the shield and the diffusion plate.

17 Claims, 4 Drawing Sheets

HIGH THERMAL DIFFUSION EFFICIENCY LIGHT DEVICE

BACKGROUND OF THE INVENTION

1. Field of the Invention

The present invention relates to a light device and more particularly to a high thermal diffusion efficiency light device.

2. Description of Related Art

Apparatus, such as projectors, that use light devices to project light are moving towards light, thin, and small design so as to meet requirement of convenience. However, the surface temperature of the light device will increase when the size of the light device shrinks. An incandescent light bulb in the light device will produce heat to rapidly increase temperature of the case of such a small light device. Therefore, the surface temperatures of the light device and the projector will exceed the limitation of safety and may burn to hurt a user. Such products are never allowed to sell because of safety.

The surface temperature is not an issue for a large light device due to enough thermal diffusion space. However, the surface temperature becomes a critical issue when it comes to a small light device. The restricted thermal diffusion space of the small light device will result in increased surface temperature. For example, the gap of a common projector between the light bulb and the case is about 1 to 2 centimeters high. Thermal problems of such size projector can be easily solved by a common air flow inlet and a fan that generates air flow. Factors that influence thermal diffusion efficiency, such as air flow path and diffusion plate, are not necessarily optimized. However, for a small light device, the size of the light bulb may be shrunken to only several square centimeters. Diffusing heat area is decreased and thermal radiation effects are increased quickly because the light bulb and the case are getting closer. There are only some easy heat diffusion methods in prior art for most traditional large projectors. For example, a case is provided to cover the light bulb and a fan is used to supply air flow; however, the air flow is not guided to perform high efficient diffusion. Most of the air flow flows randomly and does not contribute much in thermal diffusion. The light bulb is simply covered by the case and not much effort is made to restrict and make use of the air flow.

Furthermore, prior art projectors do not provide efficient shield against thermal radiation. Heat insulation material and heat reflectors are usually provided to insulate heat. However, the heat insulation material is costly. The increase in heat insulation cost is proportional to the square of increase in heat insulation efficiency. Therefore it is not practical in mass production of projectors. Further, the insulation material will add thickness to the projector. For enough insulation, the insulation material must have a certain thickness. However, the thickness will increase the size of the light device and consequently prohibits the light device from meeting the requirement of small size. The thickness is usually required to be as thin as 1 mm for a small light device in providing enough heat insulation. Such a little size is impossible for normal insulation material.

It is necessary to provide a solution to the above problems for a small light device, particularly in diffusion air flow and radiation insulation. The present invention aims to solve the problems and provides an effective solution.

SUMMARY OF THE INVENTION

The present invention discloses a light device including a light bulb set and a thermal diffusion guide disposed around the light bulb set. The light bulb set is a projection light bulb having an outer wall. The projecting light bulb is made of a luminous body and a light reflecting mask, which can be done by persons in the art and therefore will not be further described herein. The thermal diffusion guide keeps a distance from the outer wall in order to form an air passage for restricting air flow to flow through. The thermal diffusion guide has an outer rim forming a first air gap between the outer rim and the outer wall for allowing the air flow to flow into the air passage.

By the air passage, all the air flow can be effectively restricted and utilized to carry away heat for increasing thermal diffusion efficiency. And, through the first air surface, all the air flow can be restricted to pass around the light bulb set in avoidance of air flow waste and low diffusion efficiency caused by unrestricted air flow.

Preferably, the thermal diffusion guide further includes a cavity near the outer rim. The cavity forms a second air gap above the outer wall for allowing more air to flow into the air passage.

The second air surface can increase inlet air flow and to enhance the capacity of carrying away the heat.

Preferably the thermal diffusion guide further includes a narrow portion that keeps a short distance from the outer wall to form a rapid air passage. Heat is thereby rapidly removed in a limited space and thermal diffusion efficiency is increased.

To avoid overheating, the present invention further discloses a light device including a light bulb set, a shield above the light bulb set, and a diffusion plate above the shield. Wherein, a first isolation layer is formed between the shield and the diffusion plate. The light device may further include a case disposed above the diffusion plate and a second isolation layer is formed between the diffusion plate and the case.

Most of the thermal radiation is blocked by the shield from flowing outwards to device surface. The diffusion plate then disperses heat by thermal conductivity. The heat is carried away to avoid heat accumulation around the light bulb set. And the first isolation layer further reduces outward heat diffusion. The first isolation layer can be an air layer or a vacuum layer. By the introduction of the above, heat can be restricted from flowing outwards and the rest of the heat that is not blocked by the shield is further dispersed. Therefore, surface temperature is greatly lowered within limited space.

The shield may partially contact with the light bulb set and under such a circumstance the shield includes an interruption area disposed around the contact portion of the shield and the light bulb set.

Preferably the shield is high in radiation reflectivity and low in thermal conductivity. For example, the shield is made of alloy or stainless steel. The diffusion plate is preferably high in thermal conductivity. For example, the diffusion plate is a metal plate, a copper metal plate or an aluminum metal plate.

By the disclosure of the present invention, heat can be rapidly removed within limited space and a light device that meets safety requirement is provided.

DETAILED DESCRIPTION OF THE INVENTION

Figure 1:
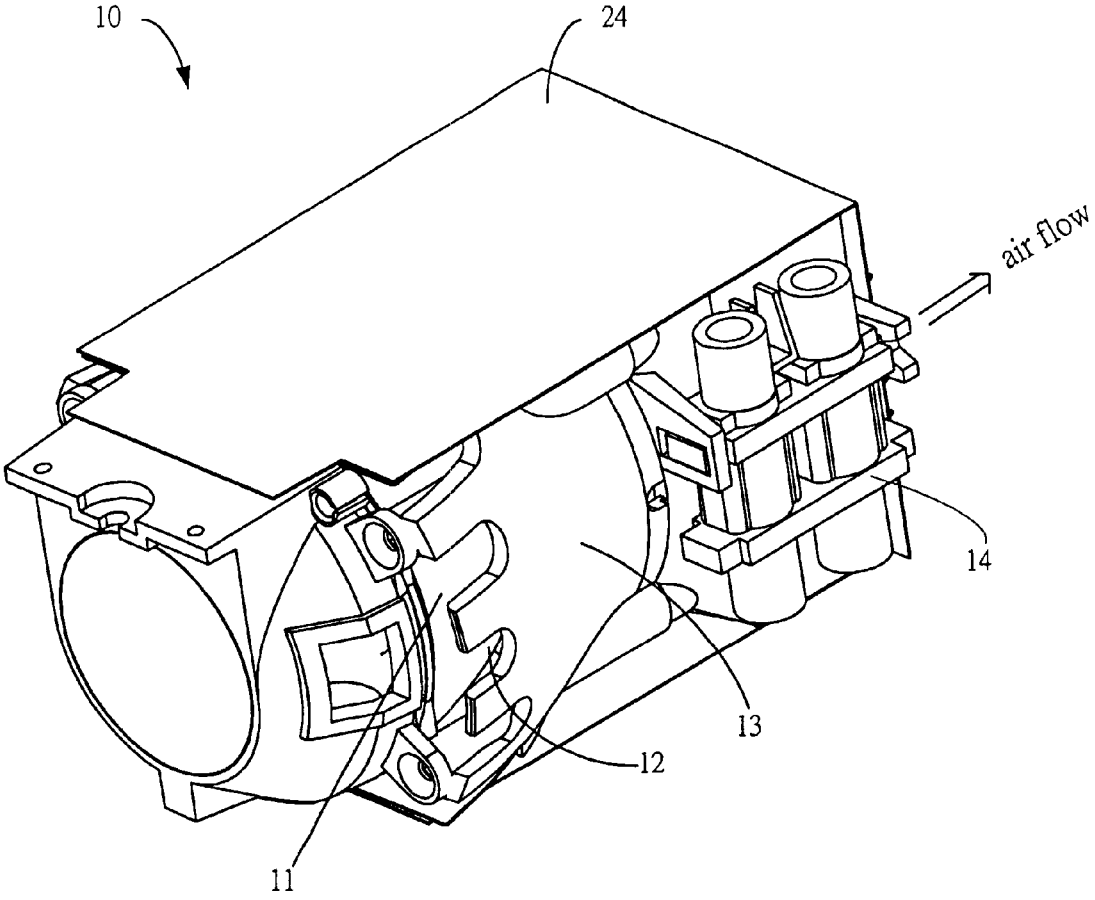
FIG. 1 depicts an appearance view of a light device according to the present invention.

Please refer to FIG. 1, depicting an appearance view of a light deice 10 according to the present invention. According to a preferred embodiment, the light device 10 includes a light bulb set 11 that has an outer wall 12. The light bulb set 11 further includes an illumination portion inside (not shown in the figure) and a reflective surface (also not shown in the figure). The light device 10 also includes a thermal diffusion guide 13 disposed around the outer wall 12. An air flow is provided by a fan (not shown in FIG. 1, please refer to a symbol 15 in FIG. 3) fixed in a fan fixer 14. The fan 15 extracts air to produce the air flow.

Figure 2:
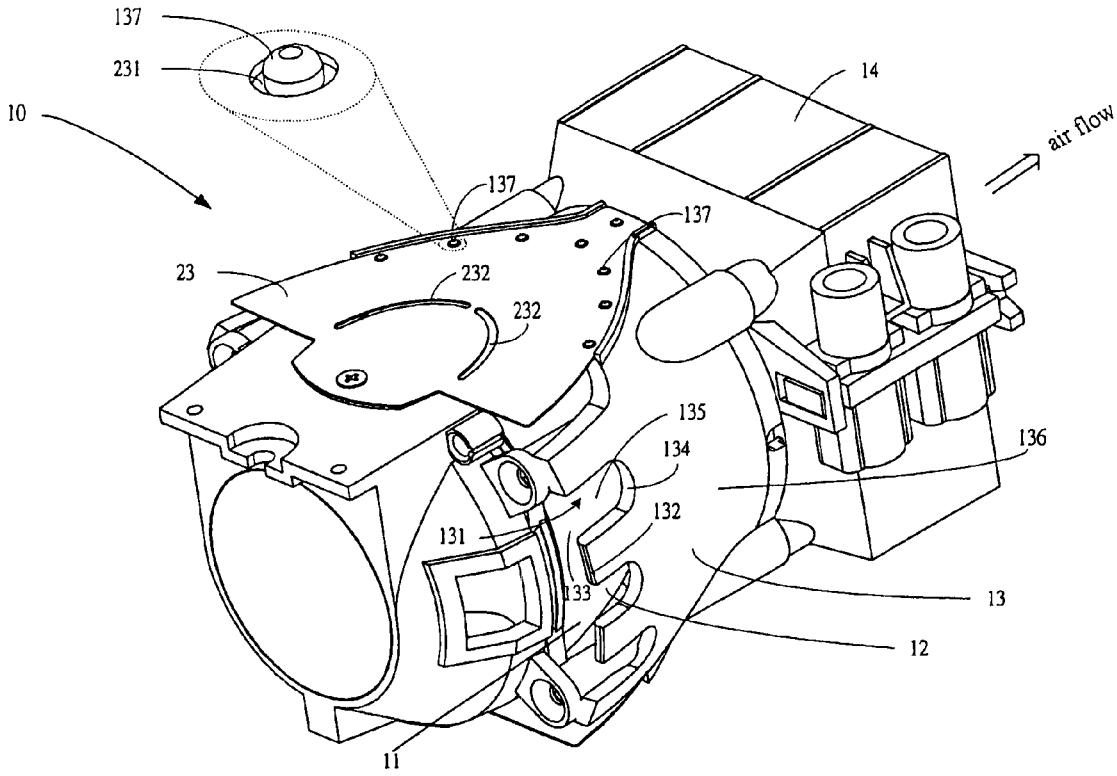
FIG. 2 depicts a composition diagram of the light device according to the present invention.

Please refer to FIG. 2, depicting an inner composition diagram of the light device 10. The thermal diffusion guide 13 keeps a distance from the outer wall 12 to form an air passage 131. The thermal diffusion guide 13 restricts the air flow to flow in the air passage 131. By the air passage 131, all the air flow is utilized to carry away heat of the light bulb set 11. Disadvantages caused by randomly flowing of the air flow can be avoided. Heat of the light bulb set 11 can be effectively removed and thermal diffusion efficiency can be increased.

Further, the thermal diffusion guide 13 includes an outer rim 132. A first air surface 133 is formed between the outer rim 132 and the outer wall 12 allowing the air flow to flow into the air passage 131. Through the first air surface 133, the air flow is made certainly to pass the outer surface of the outer wall 12. Therefore, most of the air flow is guided to flow around the outer wall 12 and to carry away heat in avoidance of air flow waste and low thermal diffusion efficiency caused by unrestricted air flow.

Preferably, the thermal diffusion guide 13 further includes a cavity 134 near the outer rim 132. A second air surface 135 is formed above the outer wall 12 allowing the air flow to flow into the air passage 131. The second air surface 135 allows the air flow to flow vertically to the outer wall 12, which allows to carry away more heat.

The second air surface 135 cooperates with the first air surface 133 to increase air flow quantity and the capacity of the air flow carrying away the heat of the light bulb set 11 as well.

The thermal diffusion guide 13 preferably further includes a narrow portion 136 whose sectional area narrows down. The narrow portion 136 keeps a short distance from the outer wall 12 so as to form a rapid air passage 131 between the outer wall 12 and the thermal diffusion guide 13. The air flow rate increases because the sectional area of the air passage is reduced. Therefore, heat is swiftly removed within limited space in meeting the requirement of the small light device 10. The thermal diffusion efficiency is further increased.

Figure 3:
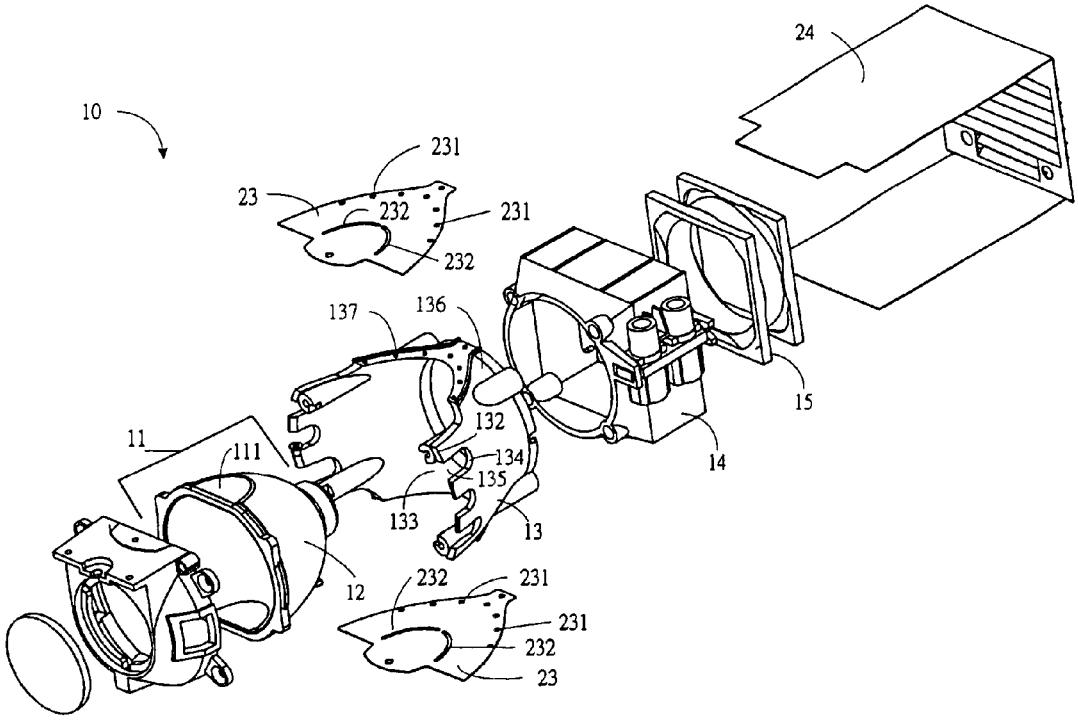
FIG. 3 depicts an explosion diagram of the light device according to the present invention.

FIG. 3 depicts an explosion diagram of the light device 10 according to the present invention. The relationship of the composition components will become more apparent in conjunction with the above description.

FIG. 1 describes a further preferred embodiment of the present invention. A light device 10 includes a light bulb set 11, a shield 23 as shown in FIGS. 2 and 3 and a diffusion plate 24.

FIGS. 2 and 3 are detailed descriptions of the composition.

The shield 23 is disposed above the light bulb set 11. The shield 23 has a plurality of holes 231 that are used to connect a plurality of supports 137 of the thermal diffusion guide 13. The shield 23 is thus fixed.

The shield 23 is preferably high in radiation reflectivity and low in thermal conductivity so as to reflect most of the heat coming from the light bulb set outer wall 12 and to prohibit the heat from diffusing outwards. For example, the shield 23 is made of alloy or stainless steel. The prohibited heat is then removed by the heat flow so as to prevent heat accumulation and high surface temperature.

Typically, the light bulb set outer wall 12 has a shrunken area 111. The shrunken area 111 is used to reduce the height of the light device 10, as shown in FIG. 3. Under such circumstance, the shield 23 contacts the light bulb set 11 and the contact portion is the shrunken area 111. The shield 23 is hence preferably has an interruption area 232 disposed around the shrunken area 111 so as to confine the heat of the shield 23 in a limited area, particularly in the area above the shrunken area 111. The temperature of the other part of the shied 23 can be desirably reduced and the expansion of thermal radiation can be reduced in avoidance of surface temperature increase.

The diffusion plate 24 is disposed above the shield 23. The diffusion plate 24 keeps a distance from the shield 23. The distance is formed by the protrudent supports 137 supporting the diffusion plate 24. Whereby, a first isolation layer (symbol 17 in FIG. 4) is formed between the diffusion plate 24 and the shield 23.

The diffusion plate 24 is preferably high in thermal conductivity, for example, a metal plate, a copper metal plate or an aluminum metal plate. Thus the heat can be swiftly taken away by conduction from the high temperature area near the outer wall 12. The diffusion plate 24, as shown in FIG. 3, is much higher in area than the shield 23 and extends backwards to carry a large quantity of heat away from high temperature area. The heat can then be dispersed into air. The large area of the diffusion plate 24 also helps to disperse heat into air.

In general, the light device 10 further includes a case (symbol 16 in FIG. 4) disposed above the diffusion plate 24. The case 16 is used to cover the light device 10. The case 16 typically forms the surface of an application apparatus, e.g. a projector, and is usually touchable by a user. The temperature of the case 16 is required to be lower than safety limit.

Figure 4:
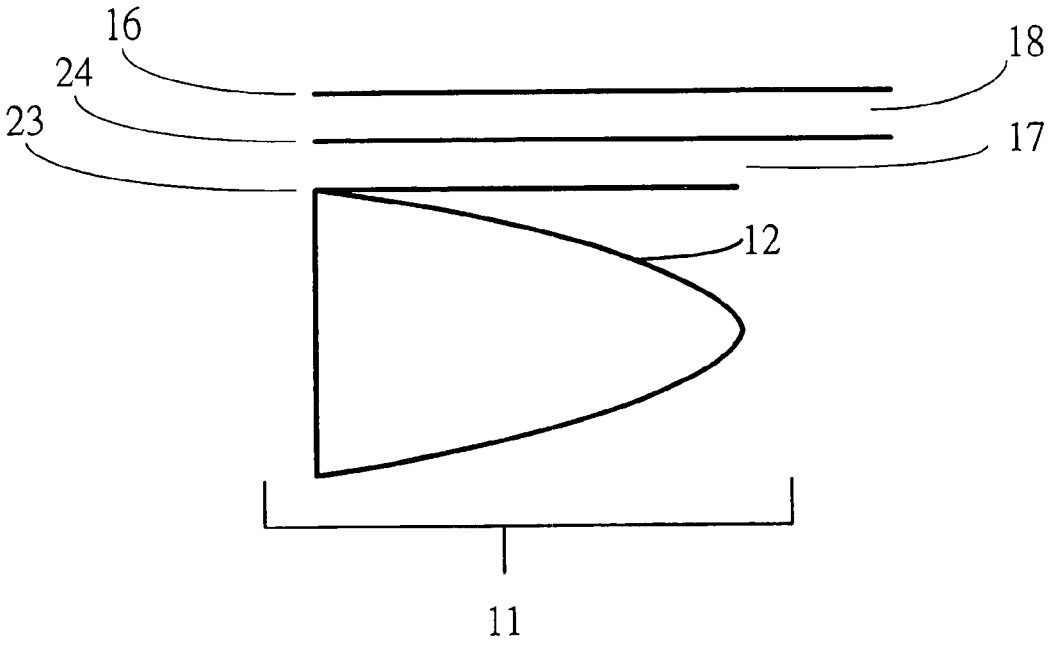
FIG. 4 briefly depicts a section view of the light device of the present invention.

Please refer to FIG. 4. A second isolation layer 18 is formed between the diffusion plate 24 and the case 16. The prior art devices do not disclose a diffusion plate and a shield between the case 16 and the light bulb set 11. Furthermore, by cooperation of the shield 23 and the diffusion plate 24, the temperature of the case 16 is greatly reduced, particularly by applying the shield 23 to prevent heat from flowing outwards and by applying the diffusion plate 24 to carry away heat. In other words, by incorporating the shield 23, diffusion plate 24 and isolation layer(s), surface temperature can be significantly reduced within limited space.

The first isolation layer 17 and the second isolation layer 18 are preferably air layers or vacuum layers. With no need of any insulation material, the surface temperature can be effectively reduced. In an embodiment of the present invention, the shield 23 is a metal plate, for example stainless steel plate, and the diffusion plate 24 is a 0.2 mm thick aluminum plate (or copper plate). The diffusion plate

24 keeps a distance of 0.5 mm respectively from the shield 23 and the case 16. Resultant measurement of the temperature is that the shield 23 keeps about 100° C., the diffusion plate 24 reduces to about 60° C., and the case 16 even reduces to about 45° C., which is far lower than the safety limit of 60° C.

By the disclosure of the present invention, heat can be efficiently removed within small space and a light device meeting the safety requirement is provided. The application of the invention includes an apparatus that comprises the disclosed light device, such as a projector. The apparatus is also intended to be protected by the present invention.

The above detailed description is to clearly describe features and spirit of the present invention and is not intended to limit the scope of the present invention. Various changes and equivalent modifications should be covered by the invention. Therefore, the scope of the present invention should be interpreted based on the following claims together with the above descriptions in the broadest way.

What is claimed is:

1. A light device comprising:

a light bulb set having an outer wall; and a thermal conductive guide disposed around the light bulb set, the thermal conductive guide keeping a distance from the outer wall to form an air passage for restricting an air flow to flow through;

wherein the thermal conductive guide has an outer rim forming a first air gap between the outer rim and the outer wall for allowing the air flow to flow into the air passage;

wherein the thermal conductive guide comprises a cavity near the outer rim forming a second air gap for allowing air flow into the air passage.

2. The light device of claim 1, wherein the thermal diffusion guide further comprises a narrow portion keeping a short distance from the outer wall to form a rapid air passage.

3. A projector comprising the light device of claim 1.

4. A light device comprising:

a light bulb set with a curved outer wall;

a heat shielding plate disposed above the curved outer wall; and a heat conductive plate disposed above the heat shielding plate, the heat shielding plate being substantially parallel to the heat conductive plate;

wherein a first air passage is formed between the heat shielding plate and the heat conductive plate for restricting a first flow of air therethrough.

5. The light device of claim 4, wherein the first isolation layer is an air layer or a vacuum layer.

6. The light device of claim 5, further comprising a case disposed above the heat conductive plate and a second air passage being formed between the heat conductive plate and the case for restricting a second flow of air therethrough.

7. The light device of claim 6, wherein the second isolation layer is an air layer or a vacuum layer.

8. The light device of claim 7, wherein the curved outer wall comprises a flat top surface, and the heat shielding plate partially overlaps with the flat top surface.

9. The light device of claim 8, wherein the shield comprises an interruption area disposed around a contact portion of the shield and the light bulb set.

10. The light device of claim 4, wherein the shield is high in radiation reflectivity and low in thermal conductivity.

11. The light device of claim 4, wherein the shield is an alloy.

12. The light device of claim 11, wherein the shield is made of stainless steel.

13. The light device of claim 4, wherein the diffusion plate is high in thermal conductivity.

14. The light device of claim 4, wherein the diffusion plate is a metal plate.

15. The light device of claim 14, wherein the diffusion plate is a copper metal plate or an aluminum metal plate.

16. The light device of claim 4, wherein the diffusion plate is higher in area than the shield.

17. A projector comprising the light device of claim 4.

* * * * *